United States Patent [19]

Silver

[11] Patent Number: 4,606,139

[45] Date of Patent: Aug. 19, 1986

[54] PREFABRICATED SHOE CONSTRUCTION

[76] Inventor: Samuel Silver, 13953 Kendale Lake Cir. #307, Miami, Fla. 33183

[21] Appl. No.: 723,831

[22] Filed: Apr. 16, 1985

Related U.S. Application Data

[63] Continuation-in-part of Ser. No. 565,909, Dec. 27, 1983, abandoned, which is a continuation-in-part of Ser. No. 324,803, Nov. 25, 1981, abandoned.

[51] Int. Cl.[4] ..... A43B 13/28; A43B 7/08; A43B 3/24

[52] U.S. Cl. ..... 36/15; 36/3 B; 36/12; 36/100

[58] Field of Search ..... 36/15, 12, 13, 3 B, 36/3 R, 100, 101, 36, 42

[56] References Cited

U.S. PATENT DOCUMENTS

| | | | |
|---|---|---|---|
| 504,660 | 9/1893 | Blandy | 36/15 |
| 1,304,646 | 5/1919 | Barber | 36/15 |
| 2,334,719 | 11/1943 | Margolin | 36/3 B |
| 3,538,628 | 11/1970 | Einstein, Jr. | 36/15 |
| 3,906,646 | 9/1975 | Millotic | 36/100 |
| 4,349,970 | 9/1982 | Silver | 36/12 X |
| 4,420,894 | 12/1983 | Glassman | 36/12 |

FOREIGN PATENT DOCUMENTS

| | | | |
|---|---|---|---|
| 555494 | 8/1943 | United Kingdom | 36/15 |

*Primary Examiner*—James Kee Chi
*Attorney, Agent, or Firm*—Peter L. Berger

[57] ABSTRACT

A prefabricated shoe construction is disclosed which includes upper and lower mid-sole members which carry mating slots and hooks permitting the sole assembly to be easily assembled. A bottom sole is also provided having, on its upper surface, spaced-apart recesses located at the periphery of the bottom sole and located respectively to each of the slots to thusly firmly engage and house within such recesses each respective hook as it is inserted into and through each corresponding slot of the lower mid-sole member. When the bottom sole of the shoe has been excessively worn, the same may be readily replaced by the user, employing the detachable mating slots and hooks to replace the sole, without need for skilled labor.

7 Claims, 9 Drawing Figures

PREFABRICATED SHOE CONSTRUCTION

REFERENCE TO RELATED APPLICATION

This application is a continuation-in-part of application Ser. No. 565,909, filed Dec. 27, 1983, which application is itself a continuation-in-part of application Ser. No. 324,803, filed Nov. 25, 1981, both now abandoned.

BACKGROUND OF THE INVENTION

This invention relates to an easy to assemble and to repair prefabricated shoe construction.

Currently, the manufacture of shoes is labor intensive, requiring many hand operations on costly machinery which increases the cost. Additionally, repair of shoes has also become extremely expensive, with the cost of repairing soles becoming prohibitive. As a consequence, it is desired to present a new and useful shoe construction which lends itself to ready assembly by non-skilled labor, with such assembly being relatively simple and fast. Further, a goal of the present invention is to provide a shoe construction which lends itself to ready replacement of the shoe elements, such as the sole and/or heel.

The prior art as best known to the inventor is represented by U.S. Pat. No. 183,675 (1876) to Hyde; U.S. Pat. No. 219,672 (1879) to Beech; U.S. Pat. No. 504,660 (1893) to Blandy; and U.S. Pat. No. 3,906,646 (1975) to Milotic.

These patents show shoes formed of component parts which are screwed together. Neither of these patents show, suggest or disclose, among other features, a prefabricated shoe construction in which an upper thin mid-sole having slots is attached to the shoe upper by adhesive or the like, and in which a lower mid-sole member has slots located in the areas which are complementary to those of the hooks in the upper mid-sole member. The bottom sole is attached to the lower mid-sole member and the sole is assembled by sliding the hooks of the upper mid-sole member into the slots of the lower mid-sole member and respective recesses of the bottom sole.

The present invention is believed to be properly classified in U.S. Class 36, Subclasses 3, 15 and 100.

SUMMARY OF THE INVENTION

The invention constitutes a prefabricated shoe construction comprising:

a shoe upper including a substantially flat bottom surface; a thin mid-sole member of a shape conforming to the shape of the bottom surface of the shoe upper, the upper mid-sole member being secured to the shoe upper, the upper mid-sole comprising a plurality of spaced-part hooks located at the periphery of the upper mid-sole; a lower mid-sole member comprising a plurality of slots formed and located respectively with each of said hooks to thereby permit said upper mid-sole member to be slid into complementary connection with said lower mid-sole member; and a bottom sole having, on its upper surface, a plurality of spaced-part recesses located at the periphery of said bottom sole and further located respectively to each of said slots to thereby firmly engage and house within the recesses each respective hook as it is inserted into and through each corresponding slot of said lower mid-sole member.

An object of the present invention is to provide a shoe construction which lends itself to ready replacement of the shoe elements, such as the sole and/or heel.

Another object of the present invention is to provide a new and expedient shoe construction which is less expensive to manufacture.

Still another object is to provide such a shoe construction in which the sole may be readily replaced by the user, without need for skilled labor and at lesser cost.

A further object of this invention is to provide such a construction which is susceptible to being widely used.

Yet another object of this invention is to provide such a shoe construction which is substantially similar to present shoe constructions, yet differs in the method and means of assembly to achieve the above objects.

A yet further object is to provide such a shoe assembly in which the elements are capable of fitting with different sized soles for broadening the applicability of the present invention.

Yet another object of the invention is to provide such a shoe construction which will be comfortable to wear, easy on the feet and prevent moisture build-up within the sole construction.

The above and yet further objects will become apparent from the hereinafter set forth Detailed Description of the Invention, the Drawings and Claims appended herewith.

DETAILED DESCRIPTION OF THE INVENTION

Figure 9:
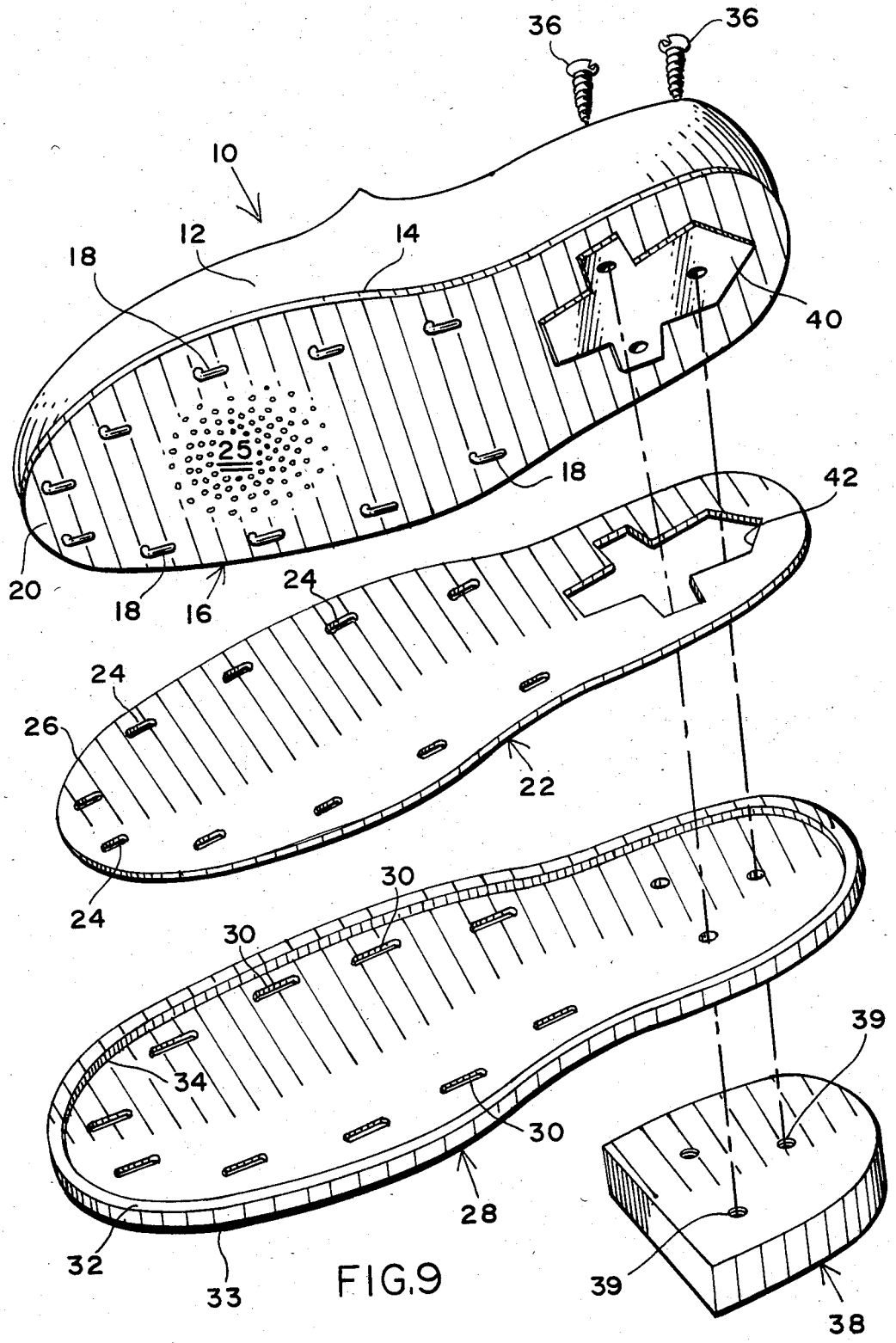
FIG. 9 is an exploded perspective view illustrating the various components of the shoe construction.

FIG. 9 is an exploded, perspective, schematic view of the present inventive prefabricated shoe construction. More particularly, there is illustrated in FIG. 9 a shoe 10 including a shoe upper 12 having a substantially flat bottom surface 14, this shoe upper being of a substantially conventional design. A heel 38 is affixed through heel base 40 and heel base opening 42 of a lower mid-sole 22. Heel base 40 is adhered to the shoe upper 12 by glueing or the like. Such attachment may also be made by means of stitching along the side edges of the thin upper mid-sole by cement, two-sided tape or other fastening means. However, it is merely required that the upper mid-sole member 16 be permanently attached to the bottom surface 14 in order for the shoe to be assembled in accordance with the principles of this invention.

As above noted, the upper mid-sole 16 is of a thin construction and is relatively flexible. It can be easily fitted to the contour of the bottom surface 14, and the outer contour of the upper mid-sole 16 will conform to the contour of the bottom surface 14 of the shoe upper 12.

The upper mid-sole is further (as is more fully explained below) provided with a plurality of hooks 18 having their primary axis substantially parallel to the surface of the upper mid-sole 16. It is noted that hooks 18 are disposed along a periphery 20 of the upper mid-sole 16.

The lower mid-sole member 22 is attached to the upper mid-sole 16 by means of peripheral elongate slots 24 which slide into hooks 18 of the upper mid-sole 16. (See description of FIGS. 3 through 8 below).

With further reference to the exploded view of FIG. 9, there is, below the lower mid-sole 22, a bottom sole 28 which includes a plurality of recesses 30 peripherally disposed thereabout with respect to the peripheral location of corresponding elongate slots 24 and hooks 18. The bottom sole 28 is further provided with a peripheral ridge 32 having an outer edge 33 and an inner edge 34.

Figure 1:
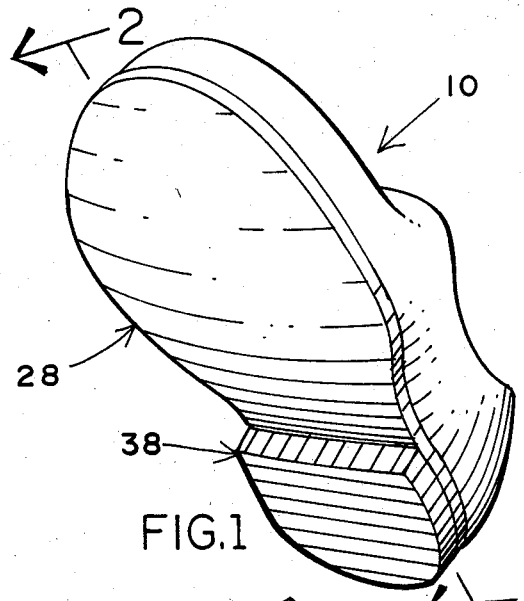
FIG. 1 is a bottom perspective view of the bottom and mid-sole structure of an assembled shoe.
Figure 2:
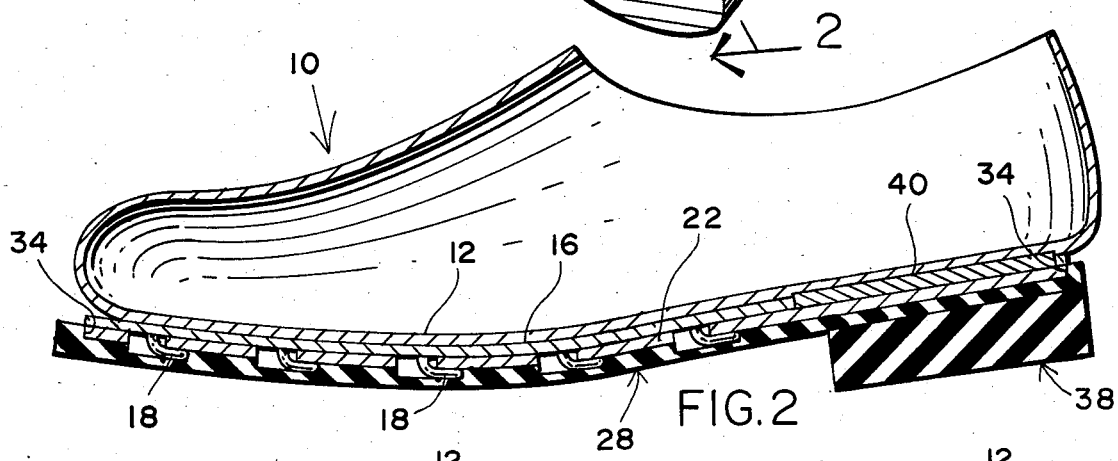
FIG. 2 is a longitudinal cross-sectional view of the shoe of FIG. 1 taken along Line 2—2 thereof.

The interaction of the upper and lower mid-sole, the shoe bottom, and the above-described system of peripheral hooks, slots and recesses is more fully illustrated in FIGS. 2 through 8. More particularly, FIG. 2 is a longitudinal view along the primary axis of the shoe illustrating each of the elements shown in FIG. 9 but, however, in a fully assembled fashion. Therein, it may be appreciated that FIG. 7 constitutes an enlarged view of one single hook, slot and recess combination of the arrangement shown in FIG. 2. More particularly, in FIG. 7 may be seen shoe upper 12, upper mid-sole 16, lower mid-sole 22, and bottom sole 28. Therein hook 18 is shown inserted through slot 22 and fully housed within recess 30 of bottom sole 28.

Figure 3:
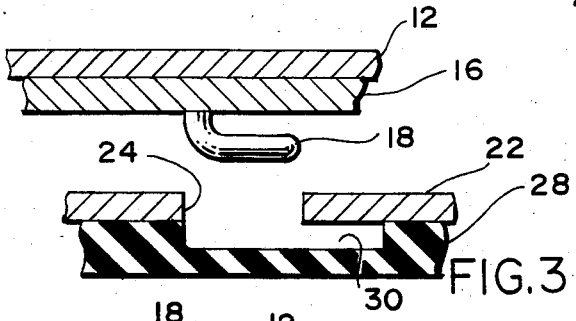
FIG. 3 is a longitudinal schematic view showing the approach of the upper mid-sole and hook structure to the lower mid-sole and bottom sole slot and recess structure respectively.
Figure 4:
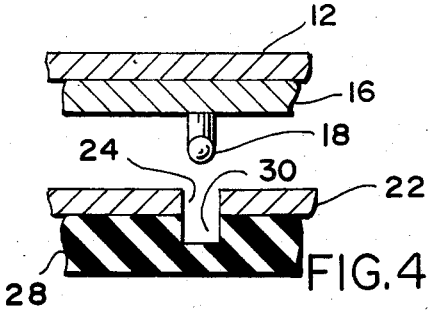
FIG. 4 is a right side view of the view of FIG. 3.
Figure 5:
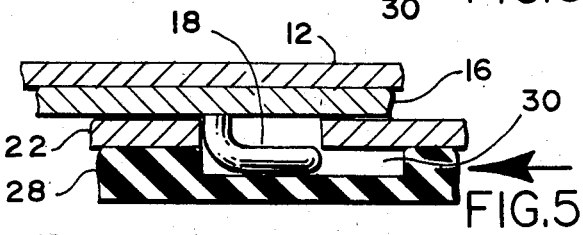
FIG. 5 is a longitudinal schematic view, similar to FIG. 3, however, showing the hook structure of the upper mid-sole inserted into the slot structure of the lower mid-sole, and recess of the bottom, before full securement of the hook into the slot and recess.
Figure 6:
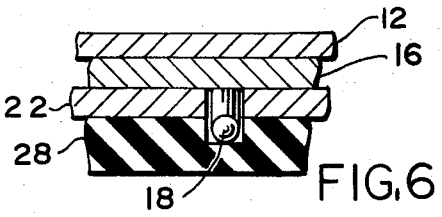
FIG. 6 is a right side view of the view of FIG. 5.
Figure 7:
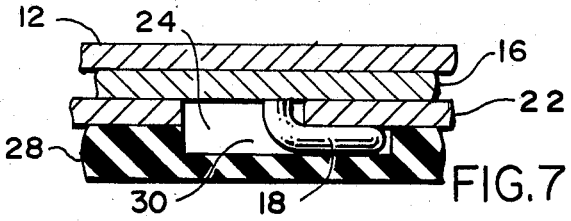
FIG. 7 is a longitudinal schematic view, similar to FIGS. 3 and 5, however, showing the hook fully inserted into the slot and recess structure of the lower mid-sole and bottom sole respectively.

The assembled arrangement of FIG. 7 is attained through the steps illustrated in FIGS. 3 through 6. In particular, in FIG. 3 the upper mid-sole 16 is shown after it has been cemented to shoe upper 12. Thereupon, it is ready to engage the combination of lower mid-sole 22 which has been cemented to the bottom sole 28. To achieve this engagement, hook 18 is, as shown in FIG. 5, pressed downward (or, conversly, bottom sole 28 pushed upward) such that hook 18 passes through slot 24 of the lower mid-sole and into recess 30 of the bottom sole. A side view of FIG. 3 is shown in FIG. 4.

Figure 8:
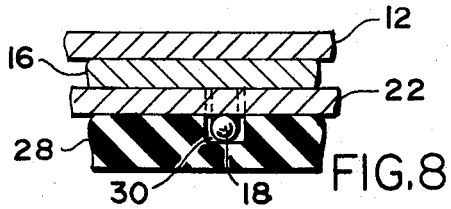
FIG. 8 is a right side view of the view of FIG. 7.

In FIG. 5, the upper mid-sole and its hook is shown after having been initially pressed downward through slot 24 but, however, prior to longitudinal movement of the lower sole in the direction indicated by the arrow in FIG. 5. After lower sole 30 has been longitudinally shifted relative to upper mid-sole 16, the hook 18 will advance forwardly within slot 24 and recess 30 to attain the "locked" position illustrated in FIG. 7. FIG. 8 is a right side view of the view of FIG. 7.

It is to be appreciated that the above-described method and structure for placing hooks 18 into slots 24 and recesses 30 may be reversed in order to detach the bottom sole and lower mid-sole from the upper mid-sole and shoe upper, as in those situations when the bottom sole has become worn and is in need of replacement. Such removal of the bottom sole and lower mid-soles is easily achieved by sliding the bottom sole and lower mid-sole assembly in the direction opposite to that of the arrow in FIG. 5. Thereby, a means is provided by which an individual, having no particular expertise in the shoe construction or repair field, can easily replace a worn shoe bottom. It is of course understood that screws 36 are first removed, thereby releasing heel 38; prior to a replacement of the bottom sole. Similarly, attachment of all components of the shoe assembly is achieved by placement of screws 36 through heel base 40, opening 42 and into holes 39 of the heel 38.

It is yet further understood that bottom sole 28 is attached to the bottom surface of lower mid-sole 26 as by cement, glue or the like. The bottom sole 28 may be made of leather, rubber or any other conventional material capable of efficient, long and comfortable wear.

It is to be further understood that the upper mid-sole 16 may be provided with a plurality of apertures 25 through the forward portion of this member. (See FIG. 9). The apertures 25 are provided to permit moisture to pass therethrough and evaporate during normal shoe wear. Additionally, provision of the large number of circular apertures allows the foot to "breathe" and enhances the wearability and comfort.

FIG. 9 includes a top view of the bottom sole 28 which includes an upstanding reinforced ridge 32 formed along the peripheral edge of the bottom sole 28. The upper and lower mid-sole members 16 and 22 also have reinforced outer edges which are slightly smaller than ridge 32 so that the mid-sole members will fit within the bottom sole 28. A slight space will exist between the outer edges of mid-sole members 16 and 22 and the inner edge 34 of ridge 32 to permit the bottom sole 28 to contract slightly according to temperature conditions while still accomodating the mid-sole members 16 and 22.

Further, the mid-sole members may be used with different size lower sole sizes. It is noted that there is provided a shank 40, for supporting the upper portion of the shoe to which the heel 38 may be replaceably attached through the mid-sole members. As above noted, one of the advantages of the present prefabricated shoe invention is that it may be easily repaired by the wearer. All that need be done when the sole or heel wears down is to lift the lower mid-sole member 22 and the bottom sole 28 away from screws or posts 36 and then slide this assembly forward to separate the lower mid-sole member from the upper. The lower mid-sole and heel assembly may be easily replaced in this fashion. The worn sole is replaced by merely re-attaching a replacement lower mid-sole 22 and bottom sole 28. The heel 38 may be easily separated from the bottom sole for easy replacement.

Such an assembly technique is also advantageous to original manufacturers since the technique is relatively simple. By reducing the cost of such assembly, the production costs are also reduced. In addition, the manufacturer of such shoes can replace the soles by merely stocking sole and lower mid-sole assemblies to replace those soles which have been sold to the general public.

The prefabricated shoe identified in this application is assembled by the SILVERWAY System. Such an assembly system has the significant advantages set forth above, and this invention has been described with the specific embodiment identified.

While there has been shown and described the preferred embodiment of the present invention, it will be understood that my invention may be embodied otherwise than as herein specifically described and that within such embodiment certain changes in the detail, quantities, and equivalents may be made without departing from the underlying idea or principles of the invention within the scope of the appended claims.

What is claimed is:

1. A prefabricated shoe construction, comprising: a shoe upper including a substantially flat bottom surface; a thin upper mid-sole member of a shape conforming to the shape of the bottom surface of the shoe upper, the upper mid-sole member being secured to the shoe upper, the upper mid-sole comprising a plurality of spaced-apart hooks located at the periphery of the mid-sole, oriented in the same direction and being substantially parallel to each other; a lower mid-sole comprising a plurality of slots formed and located respectively with each of said hooks to permit said upper mid-sole member to slide into complementary connection with said lower mid-sole member, said hooks pressing against the lower surface of said lower mid-sole member when said lower mid-sole member is slid into complementary connection with said upper mid-sole member; a bottom sole having, on its upper surface, a plurality of spaced-apart recesses being smaller than and aligned with said slots such that said hooks slide beneath said lower mid-sole member in said slot and is locked below the lower surface of said upper mid-sole member, and attachment means passing through said upper and lower mid-sole members, through the bottom sole and into a heel, to lock the upper and lower mid-sole members in position with respect to each other after the hooks are slid into said recesses.

2. The slot construction as recited in claim 1 in which said bottom sole further comprises:

a peripheral ridge which extends about the edges of both of said mid-sole members and in which said bottom sole is secured to the bottom side of said lower mid-sole member.

3. The shoe construction of claim 2 in which said per edges of said upper and lower mid-sole members are smaller than said ridge of said bottom sole, such that said mid-sole members fit within the ridge of said bottom sole and a slight spacing exists between the mid-sole members and the bottom sole along their facing edges.

4. The shoe construction of claim 3 in which said peripheral edge for said mid-sole members are reinforced.

5. The construction shoe of claim 2 wherein said upper mid-sole includes apertures through which moisture may pass.

6. The construction shoe of claim 1 wherein said attachment means comprises projections depending from the heel portion of said flat bottom surface.

7. The shoe construction as recited in claim 1, further comprising a steel heel shank attached to said upper mid-sole member, said heel comprising threaded recesses, said steel shank comprising apertures aligned with said threaded recesses such that screws may be inserted through the inside of the shoe at the heel location to secure said heel to said shoe, said heel being removeable by turning said screws.

* * * * *